US006719890B2

(12) United States Patent
Brown

(10) Patent No.: US 6,719,890 B2
(45) Date of Patent: Apr. 13, 2004

(54) CATHODE FOR A HALL-HEROULT TYPE ELECTROLYTIC CELL FOR PRODUCING ALUMINUM

(75) Inventor: Craig W. Brown, The Dalles, OR (US)

(73) Assignee: Northwest Aluminum Technologies, Seattle, WA (US)

( * ) Notice: Subject to any disclaimer, the term of this patent is extended or adjusted under 35 U.S.C. 154(b) by 30 days.

(21) Appl. No.: 10/126,068

(22) Filed: Apr. 22, 2002

(65) Prior Publication Data

US 2003/0196908 A1 Oct. 23, 2003

(51) Int. Cl.[7] ..... C25C 3/08; C25C 3/12; C25C 3/06

(52) U.S. Cl. ..... 205/379; 205/379; 205/381; 205/385; 205/386; 205/394; 205/395

(58) Field of Search ..... 205/379, 381, 205/394, 385, 386, 395, 230, 233

(56) References Cited

U.S. PATENT DOCUMENTS

| | | | | |
|---|---|---|---|---|
| 4,243,502 A | | 1/1981 | Kugler | 204/243 |
| 4,376,029 A | | 3/1983 | Joo' et al. | 204/294 |
| 4,376,690 A | * | 3/1983 | Kugler | 204/243 |
| 4,439,382 A | | 3/1984 | Joo' et al. | 24/29.5 |
| 4,456,519 A | | 6/1984 | Zöllner et al. | 204/290 |
| 4,465,581 A | | 8/1984 | Juel et al. | 204/290 |
| 4,478,693 A | | 10/1984 | Ray | 204/64 |
| 4,592,812 A | | 6/1986 | Beck et al. | 204/67 |
| 4,865,701 A | | 9/1989 | Beck et al. | 204/67 |
| 5,006,209 A | | 4/1991 | Beck et al. | 204/67 |
| 5,129,998 A | | 7/1992 | Tabereaux et al. | 204/67 |
| 5,217,583 A | | 6/1993 | Sekhar et al. | 204/67 |
| 5,227,045 A | * | 7/1993 | Townsend | 205/230 |
| 5,284,562 A | | 2/1994 | Beck et al. | 204/243 |
| 5,527,442 A | | 6/1996 | Sekhar et al. | 204/243 |
| 5,538,604 A | | 7/1996 | Keller et al. | 204/243 |
| 5,683,663 A | | 11/1997 | Keller et al. | 423/111 |
| 5,961,811 A | | 10/1999 | Keller et al. | 204/247.4 |

* cited by examiner

*Primary Examiner*—Donald R. Valentine
(74) *Attorney, Agent, or Firm*—Andrew Alexander

(57) ABSTRACT

A method of producing aluminum from alumina in an electrolytic cell including using a cathode comprised of a base material having low electrical conductivity and wettable with molten aluminum to form a reaction layer having a high electrical conductivity on said base layer and a cathode bar extending from said reaction layer through said base material to conduct electrical current from said reaction layer.

16 Claims, 2 Drawing Sheets

CATHODE FOR A HALL-HEROULT TYPE ELECTROLYTIC CELL FOR PRODUCING ALUMINUM

The government has rights in this invention pursuant to Contract No. DE-FC07-00ID13901 awarded by the Department of Energy.

BACKGROUND OF THE INVENTION

This invention relates to electrolytic production of aluminum and more particularly, it relates to an improved cathode suited for use in an electrolytic cell for the production of aluminum such as Hall-Heroult electrolytic cells.

In the electrolytic production of aluminum, there is great interest in utilizing a cathode that is highly conductive and does not react with molten aluminum deposited thereon. Carbon cathodes which are traditionally used in the Hall-Heroult cells have the problem that they are not readily wettable with molten aluminum. The carbon cathode surface reacts with the molten aluminum and forms aluminum carbide. Thus, the cathode is depleted at about 2 to 5 cm/yr. during operation of the cell. Or, the carbon cathode has the problem that it permits formation of cyanides, presenting a disposal problem. Thus, the carbon cathode has been replaced or modified with materials to improve its performance.

For example, U.S. Pat. No. 5,961,811 discloses an improved carbonaceous material suitable for use as a cathode in an aluminum producing electrolytic cell, the cell using an electrolyte comprised of sodium containing compounds. The carbonaceous material is comprised of carbon and a reactive compound capable of suppressing the formation or accumulation of sodium cyanide during operation of the cell, of reacting with sodium to reduce problems associated with sodium intercalation, and of reacting with one of titanium or zirconium to form titanium or zirconium diboride during operation of the cell to produce aluminum.

U.S. Pat. No. 5,217,583 discloses electrodes suitable for electrochemical processing which are a preferred product form, particularly electrodes for use in the electrowinning of aluminum from its oxide. According to the patent, such products are comprised of a dimensionally stable combustion synthesis product of a composition containing at least 20% by weight of a particulate combustible material; at least 15% by weight of a particulate filler material capable of providing desired mechanical and electrical properties; and up to 35% by weight of a particulate inorganic binder having a melting point lower than the combustion synthesis temperature.

U.S. Pat. No. 4,243,502 discloses a wettable cathode for an electrolytic cell for the electrolysis of a molten charge, in particular for the production of aluminum, where the said cathode comprises individual, exchangeable elements each with a component part for the supply of electrical power. The elements are connected electrically, via a supporting element, by molten metal which has separated out in the process. The interpolar distance between the anodes and the vertically movable cathode elements is at most 2 cm.

U.S. Pat. No. 4,376,029 discloses a cathode component for a Hall aluminum cell which is economically produced from a mixture of a carbon source, preferably calcined petroleum coke, and optionally calcined acicular needle petroleum coke, calcined anthracite coal; a binder such as pitch including the various petroleum and coal tar pitches; titanium dioxide, $TiO_2$; and boric acid, $B_2O_3$ or boron carbide, $B_4C$; forming said mixture into shapes and heating to a $TiB_2$-forming temperature.

U.S. Pat. No. 4,439,382 discloses that titanium diboride graphite composite articles are produced by mixing $TiO_2$, petroleum coke and a binder to form a plastic dispersion. Articles are shaped by molding or extrusion and baked to carbonize the binder to form a baked carbon-$TiO_2$ composite. The article is impregnated with a molten or dispersed boron compound, then heated to drive $TiB_2$ forming reaction. The article is then further heated to a graphitizing temperature to form a graphite-$TiB_2$ composite useful as a cathode component in a Hall aluminum reduction cell.

U.S. Pat. No. 4,456,519 discloses an electrode made of a number of elongated elements which are plates, rods or tubes. The elements are composed of inorganic conductive fibers embedded in a solid, electrochemically active material. The fibers are oriented in the direction of current flow.

U.S. Pat. No. 4,465,581 discloses that $TiB_2$-graphite composite articles suitable for use as cathode components in a Hall aluminum reduction cell are made by impregnating a $TiO_2$-carbon composite with a boron compound and carbon black dispersed in water, or alternately by impregnating a boron or boron compound-carbon composite with a carbon black-$TiO_2$ dispersion, and heating the article to a reaction temperature whereby $TiB_2$ is formed and the amorphous carbon converted to graphite. The article may be impregnated with a carbonizable liquid, re-baked, and re-heated to a graphitizing temperature to increase its strength and density.

U.S. Pat. No. 4,478,693 discloses an inert type electrode composition suitable for use in the electrolytic production of metals such as aluminum. The aluminum is produced from an aluminum-containing material dissolved in a molten salt. The electrode composition is fabricated from at least two metals or metal compounds combined to provide a combination metal compound containing at least one of the group consisting of oxide, fluoride, nitride, sulfide, carbide or boride.

U.S. Pat. No. 5,129,998 discloses that the density of various refractory hard metal articles are controlled so that articles made from the refractory hard metals are able to float on the surface of molten aluminum. Floating such articles on aluminum has been found to both stabilize and protect the surface of molten aluminum. Floating cathodes for use in aluminum reduction cells is a particular application for the floating refractory hard metals.

U.S. Pat. No. 5,527,442 discloses a carbonaceous, refractory or metal alloy substrate material coated with a refractory material, the refractory material including at least one of borides, silicides, nitrides, aluminides, carbides, phosphides, oxides, metal alloys, inter-metallic compounds and mixtures of one of titanium, chromium, zirconium, hafnium, vanadium, silicon, niobium, tantalum, nickel, molybdenum and iron and at least one refractory oxide of rare earth metals. An aluminum production cell including a component made up of a material coated with the coating described above is also disclosed.

U.S. Pat. No. 5,538,604 discloses an improved carbonaceous material suitable for use as a liner in an aluminum producing electrolytic cell, the cell using an electrolyte comprised of sodium containing compounds and the carbonaceous material penetrable by sodium or nitrogen and resistant to formation or accumulation of sodium cyanide during operation of the cell. The carbonaceous material is comprised of carbon and a reactive compound capable of reacting with one of sodium, nitrogen and sodium cyanide during operation of the cell to produce aluminum, the reactive compound present in an amount sufficient to suppress formation or accumulation of cyanide compounds in the liner.

U.S. Pat. No. 5,006,209 discloses that cathodes for use in low temperature cells 660° to 800° C. are typically composed of an electrically conductive, refractory hard metal which is wet by molten aluminum and stands up well in the bath under operating conditions and that the preferred cathode material is titanium diboride. U.S. Pat. No. 4,865,701 discloses that other useful cathode materials include titanium carbide, zirconium carbide, zirconium diboride, niobium diboride, tantalum diboride and combinations of said diboride in solid solution form, e.g., $(Nb, Ta)B_2$.

In spite of these disclosures, there is still need for an improved cathode suitable for use in an electrolytic cell for producing aluminum.

SUMMARY OF THE INVENTION

It is an object of the invention to provide an improved cathode for use in an electrolytic cell for reducing alumina to aluminum in a molten salt.

It is another object of the invention to provide a cathode comprised of a base material having high electrical resistivity for use in an electrolytic cell for reducing alumina to aluminum in a molten salt.

It is yet another object of the invention to provide a composite cathode comprised of a base material having high electrical resistivity and having a reaction layer thereon.

Still, it is another object of the invention to provide a composite cathode comprised of a boron carbide or zirconium oxide base material and a layer wettable with molten aluminum.

Yet another object of the invention is to provide a cathode comprised of a base material having high electrical resistivity for use at a temperature above 900° C. in an electrolytic cell for producing aluminum from alumina dissolved in a molten salt.

Still it is another object of the invention to provide a cathode comprised of a base material having high electrical resistivity suitable for reaction with molten aluminum to provide an aluminum wettable layer for use in an electrolytic cell for reducing alumina to aluminum in a molten salt.

These and other objects will become apparent from a reading of the specification and claims and an inspection of the drawings appended hereto.

In accordance with these objects, there is provided a method of producing aluminum from alumina in an electrolytic cell comprising the steps of providing a molten salt electrolyte in an electrolytic cell having alumina dissolved therein, the molten electrolyte having a surface and having a frozen crust thereon, the cell having a bottom and sides extending upwardly from the bottom to contain the electrolyte. The method includes providing an anode extending through the surface into the electrolyte. A cathode is provided on the bottom of the cell and the cathode is comprised of a base material having low electrical conductivity or high electrical resistivity. The base material is reactive with molten aluminum to form a reaction layer wettable with aluminum. Thus, in operation a layer of molten aluminum is provided thereon. Means such as a cathode bar extends from the layer of molten aluminum to bus bar outside the cell to conduct electrical current from the cell. The cathode bar can extend from the layer of molten aluminum through the reaction layer through the base material outside the cell to conduct electrical current from the cell. In the method, electrical current is passed from the anode through the electrolyte to the cathode, thereby reducing alumina in the electrolyte and depositing aluminum at the cathode.

The electrolyte preferably is molten at a temperature over 900° C. When the base material is boron carbide, for example, molten aluminum is reactive therewith to form a layer containing aluminum boride wettable with molten aluminum. The anode may be comprised of carbon or cermet or other material which can function as an anode. The cathode can be prepared by providing a base material having low electrical conductivity or high electrical resistivity such as boron carbide and contacting or reacting the surface of the base material to provide a layer such as aluminum boride wettable with molten aluminum. This permits low electrically conductive material having high stability in molten aluminum to function as a cathode.

DETAILED DESCRIPTION OF PREFERRED EMBODIMENTS

Figure 1:
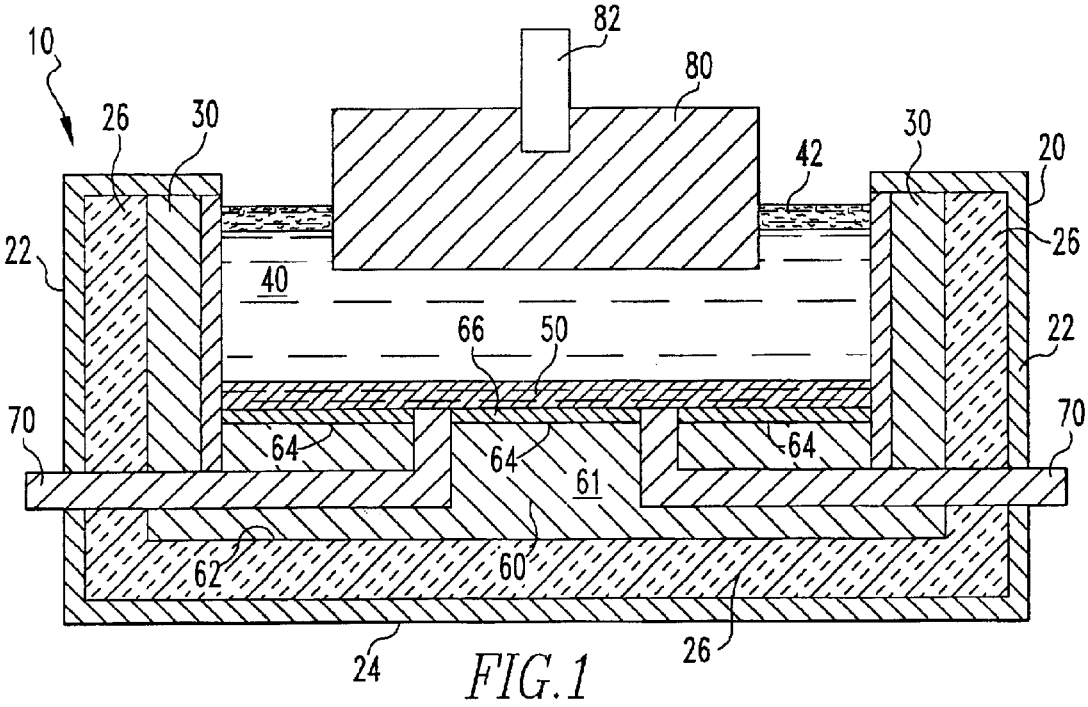
FIG. 1 is a cross-sectional view of a Hall-Heroult type cell in accordance with the invention.

Referring now to FIG. 1 there is illustrated an electrolytic cell 10 for use in electrolytically reducing alumina to aluminum in accordance with the invention. Typically, cell 10 is comprised of a steel shell 20 having sides 22 and bottom 24. Sides 22 and bottom 24 may be provided with a layer of thermal insulation 26. A lining 30 is provided inside insulation layer 26 to contain molten electrolyte 40 and molten aluminum 50. Lining 30 may be comprised of carbon or graphite blocks or other suitable material. Anode 80, supported by anode rod 82, is shown immersed in molten electrolyte 40. As seen in FIG. 1, anode 80 projects through frozen electrolyte layer 42 into the electrolyte. The anode may be comprised of carbon material or cermet or other suitable material.

The cell typically uses molten cryolite electrolyte at temperature above 900° C., e.g., in the range of 930° to 980° C. although other electrolytes may be used.

Cathode 60 is located or positioned on top of insulation 26 and extends across the bottom of cell 10, Cathode 60 is comprised of a base material 61 having bottom surface 62 that rests on insulation 26 and a top surface 64. In accordance with the invention, top surface 64 comprises a layer 66 on which rests a layer or pool of molten aluminum 50.

Cathode 60 is comprised of a base material 61 having a high electrical resistivity, e.g., higher than 0.1 ohm·cm and is reactive with molten aluminum to form a reaction layer 66 on the base material. The reaction layer is wettable with a layer of molten aluminum. Cathode 60 is further comprised of cathode bars 70 which conduct electrical current from the layer of molten aluminum through low electrical conductive base material 61 to bus (not shown) outside the cell. It will be understood that cathode bars 70 are shown by way of example and any electrical conducting means that conducts current away from molten aluminum layer 50 to outside bus may be used.

It should be noted that cathode bars 70 may extend into molten aluminum 50 and thus should be comprised of a material having good electrical conductivity and low solubility in aluminum. Thus, any materials having these properties are suitable for cathode bars of the invention. Examples of such material include titanium diboride, and zirconium diboride, with titanium diboride being preferred.

Preferably, cathode 60 is comprised of a base material selected from the group consisting of boron carbide, and zirconium dioxide. Typically, such materials have a high electrical resistivity, e.g., greater than 0.1 ohm·cm and in the range of 0.1 to $1\times10^{12}$ ohm·cm. To function as cathodes in an electrolytic cell where alumina is reduced to aluminum, the base materials are required to be wetted by molten aluminum at the cell operating temperature or be reactive with molten aluminum to form a layer 66 on the base material wettable by molten aluminum layer 50. Layer 50 provides a highly electrically reactive layer 66 which conducts current and thus permits the base material and conductive layer to function as a cathode. The preferred base material is boron carbide. Base materials such as boron carbide have the advantage that they are stable in molten aluminum.

Prior to using cathode 60 in an electrolytic cell, it should be treated first to provide a thin layer of aluminum on the base material to provide for pre-wetting. For example, the layer of aluminum can be provided on the base material by dipping or immersing the cathode in molten aluminum. To avoid thermal shock, the cathode may be pre-heated before immersion. Time of immersion can be a few seconds to a few minutes, e.g., 2 seconds to over 10 minutes. The temperature of the molten aluminum can range from 660° to 1000° C. It should be understood that any method can be used to apply a layer of aluminum on the base material constituting the cathode and includes flame spraying or dipping through flux. It should be understood that the cathode can comprise a number of blocks comprised of base material provided to cover the floor of cell 10. After the blocks are position in the cell, they may be treated to provide a thin layer of aluminum thereon to provide for pre-wetting.

After coating the base material with aluminum, cathode 60 is covered with electrolyte. In the cell illustrated in FIG. 1, during electrolysis, molten aluminum 50 collects as a layer on cathode 60.

While not wishing to be held to any theory of invention, in the case of boron carbide, the wetted cathode may comprise three layers in which the base material constitutes a first layer. When the base material is reacted with molten aluminum, a molten aluminum wettable reaction layer forms such as aluminum boride. The aluminum boride is wettable with molten aluminum providing the third layer which is the active cathode during electrolysis.

While reference is made herein to boron carbide base material, it should be understood that the cathode base material can comprise a composite of, for example, boron carbide and other refractory material. The composite may be constituted of, for example, sufficient boron carbide to provide a molten aluminum wettable surface.

Figure 2:
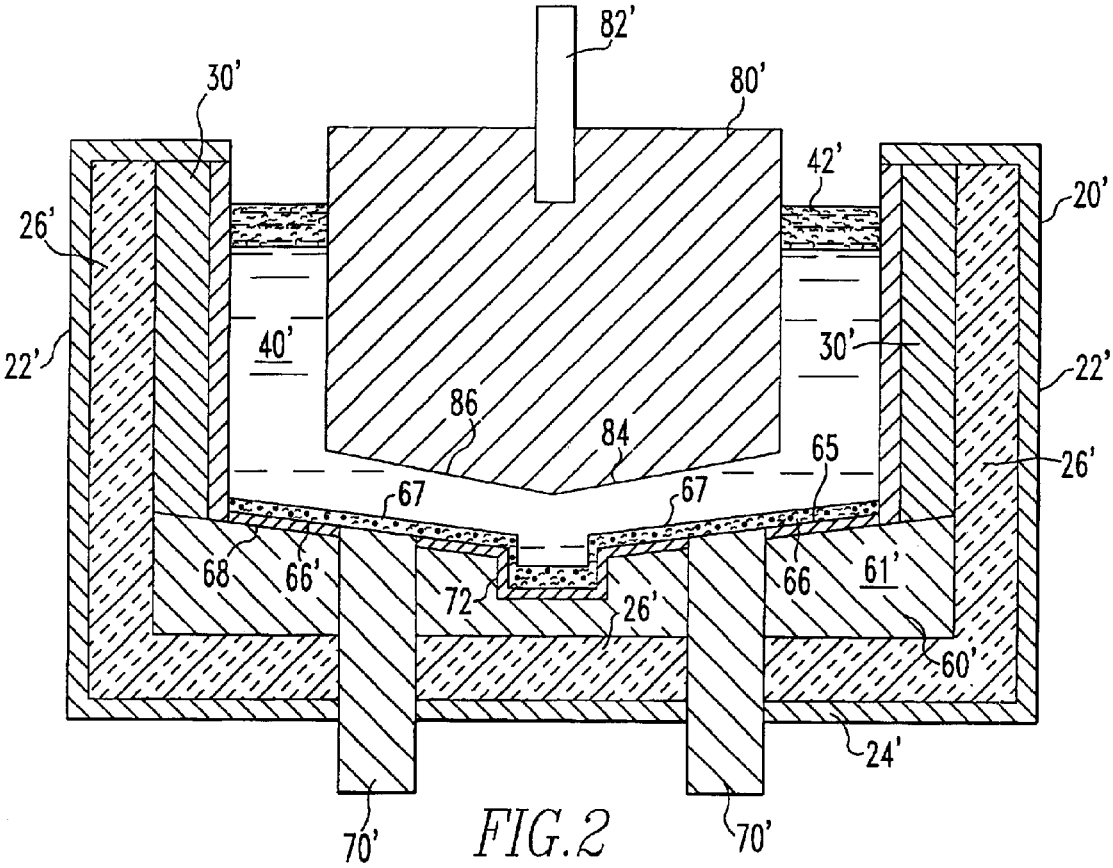
FIG. 2 is a cross-sectional view of an electrolytic cell showing a drained cathode in accordance with the invention.

FIG. 2 shows another embodiment of the invention wherein like parts use like numbers. The cell illustrated in FIG. 2 is comprised of a steel shell 20' having sides 22' and bottom 24'. Sides 22' and bottom 24' may be provided with a layer of thermal insulation 26'. A lining 30' is provided inside insulation layer 26' to contain molten electrolyte 40'. Lining 30' may be comprised of carbon or graphite blocks. An anode 80' supported by anode rod 82' is shown immersed in molten electrolyte 40'. Also, as shown in FIG. 2, anode 80' projects through a frozen crust or electrolyte layer 42' into the electrolyte. The anode may be comprised of carbon or cermet or other material suitable for an anode.

Cathode 60' is positioned on top of insulation layer 26' and extends across the bottom of the cell. Cathode 60' in FIG. 2 has a top surface 68 which is sloped inwardly to a reservoir or sump 72. As described with respect to the cathode in FIG. 1, cathode 60' in FIG. 2 is comprised of a base material 61' having a low electrical conductivity or high electrical resistivity and reactive with molten aluminum to form reactive layer 66' on the base material. The base material 61' may be comprised from the materials described herein for the novel cathode.

Anode 80' in FIG. 2 has bottom surfaces 84 and 86 positioned over cathode surfaces 68 and preferably disposed substantially parallel to cathode surfaces 68 as shown in FIG. 2 to provide a substantially uniform anode-cathode distance between the two electrode surfaces.

In FIG. 2, conductor bars 70' are shown extending through reactive layer 66' through bottom 24' of the cell to conduct electrical current from layer 67'. When the cell of FIG. 2 is operated, electrical current flows from anode 80' through electrode 40' to layer 67' and through conductor bars 70'. Alumina is converted to aluminum which is deposited at reactive layer 66'. The aluminum deposited at the cathode can form a thin layer 67 of aluminum, as noted, which continuously drains into sump 72 and is removed from the cell. Thus, this feature of the invention provides a drained cathode. This is beneficial in that a pool of aluminum subject to swirling and magnetic effects is avoided and thus a smaller anode-cathode distance with its advantages can be maintained without the problem of electrically shorting the cell. It will be appreciated that sump 72 is illustrative and other drained cathodes may be used and such are contemplated within the purview of the invention.

A boron carbide cathode in accordance with the invention was tested in the electrolytic cell of FIG. 1. A sample of boron carbide was fastened to a length of copper tubing. The sample was preheated and then immersed in molten aluminum at 760° C. for about 60 seconds. After removal from the molten aluminum, the sample was coated or wetted with a thin layer of molten aluminum. The cathode was positioned in a 10 ampere test cell, as described in co-pending application entitled "Improved Cathode for Aluminum Producing Electrolytic Cell", Ser. No. 10/126,104, incorporated herein by reference. The cell contained a metal anode and a low temperature electrolyte comprised of about 250 grams of a two-component $NaF/AlF_3$ eutectic composition. The electrolyte and metal anode were heated to 760° C. The coated cathode was heated external to the cell before being positioned in the molten electrolyte. The copper lead of the cathode was connected to an electrolysis power supply. A current of 3.64 amps was applied to the cell at a current density of 0.33 amps/$cm^2$ for a period of 2 hours and then the current was increased to 5.64 amps for another hour. During this period, cell voltage was measured and averaged 3.37 V. After 3 hours, the cell was disassembled and based on the amount of aluminum recovered, an overall current efficiency of 83% was obtained. Thus, the pre-wetted boron carbide was found to serve as a cathode in an electrolytic cell for producing aluminum from alumina.

Having described the presently preferred embodiments, it is to be understood that the invention may be otherwise embodied within the scope of the appended claims.

What is claimed is:

1. A method of producing aluminum from alumina in an electrolytic cell comprising the steps of:

(a) providing a molten salt electrolyte in an electrolytic cell having alumina dissolved in the molten electrolyte comprised of at least one or more alkali metal fluorides and at least one other metal fluoride, the molten electrolyte having a surface and having a frozen crust thereon, the cell having a bottom and sides extending upwardly from said bottom to contain said electrolyte;

(b) providing an anode extending through said surface into said electrolyte;

(c) providing a cathode on said bottom said cell, said cathode comprised of:

(i) a base material having high electrical resistivity and reactive with molten aluminum to form a reaction layer on said base material wettable with molten aluminum to maintain a layer of molten aluminum on the reaction layer; and (ii) means for conducting electrical current from said molten aluminum layer; and (d) passing electric current from said anode through said electrolyte to said cathode thereby reducing said alumina in said electrolyte and depositing aluminum at said cathode.

2. The method in accordance with claim 1 wherein said base material is a material selected from the group consisting of boron carbide, and zirconium dioxide.

3. The method in accordance with claim 1 including using an electrolyte comprised of NaF and $AlF_3$ eutectic, KF and $AlF_3$ eutectic and LiF.

4. The method in accordance with claim 1 wherein said anode is a carbon anode.

5. The method in accordance with claim 1 wherein said base material is comprised of boron carbide.

6. The method in accordance with claim 1 wherein said base material has a resistivity of greater than 0.01 ohm·cm.

7. The method in accordance with claim 1 wherein said anode is a cermet or a carbon anode.

8. The method in accordance with claim 1 wherein said electrolyte is cryolite.

9. A method of producing aluminum from alumina in an electrolytic cell comprising the steps of:

(a) providing a molten salt electrolyte in an electrolytic cell having alumina dissolved in the molten electrolyte, the molten electrolyte having a surface, the cell having a bottom and sides extending upwardly from said bottom to contain said electrolyte;

(b) providing an anode extending through said surface into said electrolyte;

(c) providing a cathode on said bottom said cell, said cathode comprised of:

(i) a base material comprised of boron carbide;

(ii) a layer of aluminum carbide on said base material, said aluminum carbide wettable with molten aluminum; and (iii) a layer of molten aluminum on said aluminum carbide;

(iv) a cathode bar in electrical communication with said layer of molten aluminum;

(d) passing electric current from said anode through said electrolyte to said cathode; and (e) reducing said alumina and depositing aluminum at said cathode.

10. A method of producing aluminum in an electrolytic cell comprising the steps of:

(a) providing molten salt electrolyte at a temperature greater than 900° C. in an electrolytic cell having alumina dissolved in said electrolyte;

(b) providing an anode in said electrolyte;

(c) passing electric current from an anode through said electrolyte to a cathode disposed on the bottom of said cell, said cathode comprised of:

(i) a boron carbide base material wettable with molten aluminum forming a reaction layer on said base material wettable by a layer of molten aluminum; and (ii) a cathode bar in electrical communication with said layer of molten aluminum, and (d) reducing said alumina and depositing aluminum at said cathode.

11. The method in accordance with claim 10 including using an electrolyte comprised of at least one or more alkali metal fluorides and at least one other metal fluoride.

12. The method in accordance with claim 10 including using cryolite.

13. The method in accordance with claim 10 including accumulating a layer of molten aluminum on said cathode and periodically siphoning said molten aluminum from said cell.

14. The method in accordance with claim 10 including providing said cathode with a draining surface which conveys aluminum deposited thereon to a sump for removal from said cell.

15. The method in accordance with claim 10 wherein the anode is a carbon anode.

16. The method in accordance with claim 10 wherein the anode is a cermet anode.

* * * * *